US005301449A

United States Patent [19]

Jackson

[11] Patent Number: 5,301,449

[45] Date of Patent: Apr. 12, 1994

[54] MAGAZINE CARTRIDGE LOADER

[76] Inventor: Terry R. Jackson, 1624 S. Rouse, Bozeman, Mont. 59715

[21] Appl. No.: 975,721

[22] Filed: Nov. 13, 1992

[51] Int. Cl.[5] ..... F41A 9/83

[52] U.S. Cl. ..... 42/87; 86/47

[58] Field of Search ..... 42/87, 88; 86/45, 46, 86/47

[56] References Cited

U.S. PATENT DOCUMENTS

| | | | |
|---|---|---|---|
| 3,983,782 | 10/1976 | Sawyer | 42/87 |
| 4,034,644 | 7/1977 | Hupp et al. | 42/87 |
| 4,392,321 | 7/1983 | Bosworth | 42/87 |
| 4,739,572 | 4/1988 | Brandenburg | 42/87 |
| 4,879,829 | 11/1989 | Miller et al. | 42/87 |
| 4,970,820 | 11/1990 | Miller et al. | 42/87 |

*Primary Examiner*—Stephen C. Bentley
*Attorney, Agent, or Firm*—Richard C. Conover

[57] ABSTRACT

This invention utilizes a conventional type cartridge orienting device for orienting cartridges with their longitudinal axes aligned generally parallel with one another. The present invention includes a hollow receptacle having a cartridge accepting device. This accepting device includes a stop wall to allow only one oriented cartridge to drop into the accepting device at a time. A rotatable cam is provided within the accepting device. Upon rotation of the rotatable cam, cartridges are grasped and moved away from the accepting device and transported by the rotatable cam upon further rotation thereof to the receiving end of a conventional magazine. The cartridge is then forced into the magazine when the rotatable cam is further rotated.

5 Claims, 3 Drawing Sheets

MAGAZINE CARTRIDGE LOADER

BACKGROUND OF THE INVENTION

This invention relates to an improved magazine cartridge loader and in particular to an apparatus for orienting a plurality of cartridges and loading the oriented cartridges into a magazine for use with firearms.

Devices for loading multiple cartridges into a magazine are known. For example, U.S. Pat. No. 4,739,572 to Brandenburg shows a device including two cam followers to move a cartridge in two linear directions to load the cartridge into a magazine. U.S. Pat. No. 4,970,820 to Miller et al illustrates the use of a spring loaded feed finger to achieve the proper transport motion to load a cartridge into a magazine.

Further, there are several references which show star wheels used to load cartridges into a magazine. These patents utilize the star wheel to separate an advancing column of cartridges aligned end to end into a sequence of cartridges to be transported by other mechanisms to the magazine. For example, U.S. Pat. No. 4,034,644 to Hupp et al.; U.S. Pat. No. 4,879,829 to Miller et al.; and U.S. Pat. No. 3,983,782 to Sawyer all provide examples of star wheels used in this fashion.

All of these patents illustrate complex mechanisms to load cartridges into a magazine and none of these patents show a simple rotatable cam for accepting a cartridge and forcing it into a magazine.

SUMMARY OF INVENTION

The present invention relates to a magazine cartridge loader utilizing a single rotatable cam for grasping a single cartridge and moving the single cartridge into a magazine.

The invention utilizes a conventional type cartridge orienting device such as shown in U.S. Pat. No. 4,392,321 to Bosworth. This orienting device includes a hollow receptacle having a slot separating two rails. Cartridges placed in the hollow receptacle are directed toward the slot. The width of the slot is sized to accept only the body of the cartridge, but not the rim. Thus the nose of the cartridge can fall into the slot and the rim will stop the falling motion, because the rails will engage the rim to suspend the cartridge by its rim. When a plurality of unoriented cartridges are placed in the hollow receptacle and the receptacle shaken, the cartridges are uniformly aligned automatically in the slot with their longitudinal axes aligned generally parallel within the slot. In using the present invention the slot is positioned to slope downward toward one end of the hollow receptacle which end is in communication with an accepting device. This accepting device includes a stop wall to allow only one oriented cartridge to drop into the accepting device at a time. A rotatable cam is provided within the accepting device. Upon rotation of the rotatable cam, a cartridge is grasped and moved away from the accepting device and transported by the rotatable cam upon further rotation thereof to the receiving end of a conventional magazine. The cartridge is then forced into the magazine when the rotatable cam is further rotated.

This simple structure, which is a considerable improvement over previously known devices, eliminates the necessity for several moving parts to load aligned cartridges into a magazine and is virtually fail safe.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
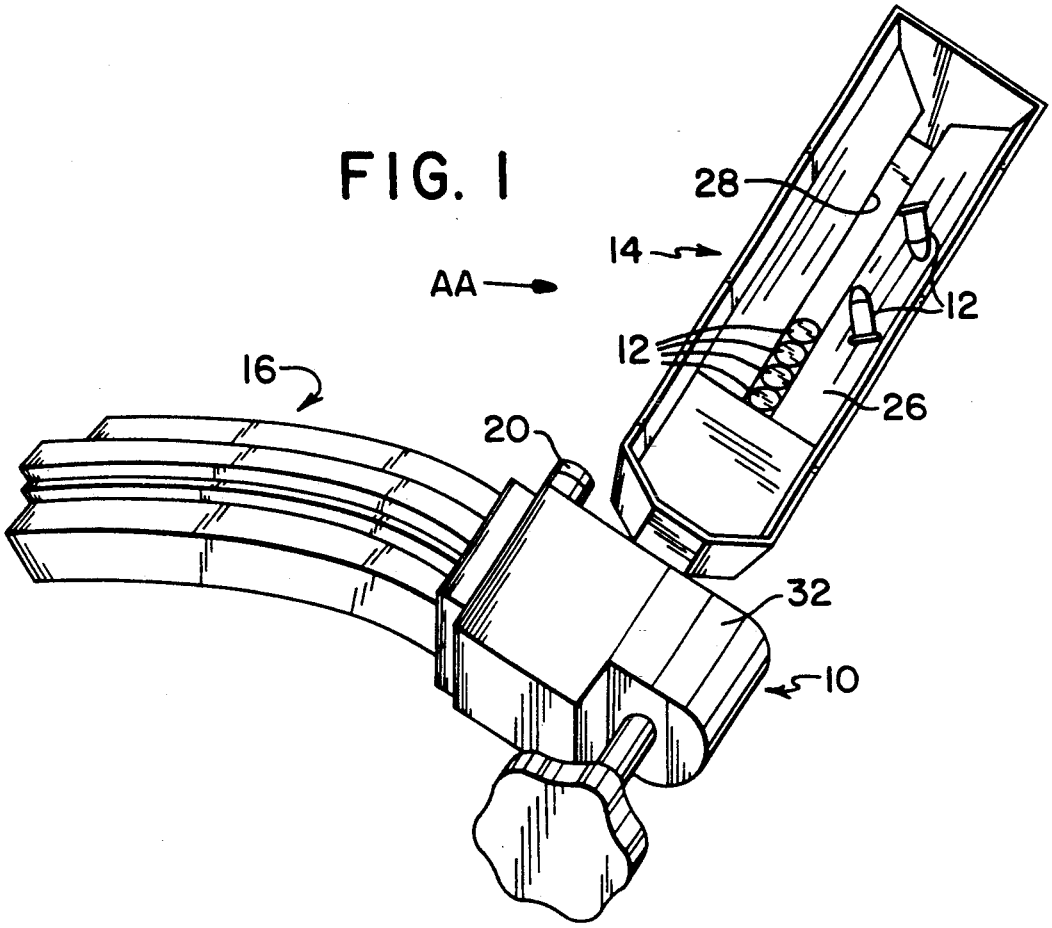
FIG. 1 is a perspective view of the magazine cartridge loader of the present invention with a magazine held in position.

A preferred embodiment of the magazine cartridge loader 10 according to the present invention is shown in FIG. 1. The loader 10 accepts cartridges 12 from a cartridge orienting device 14 and loads these cartridges into a magazine 16.

Figure 2:
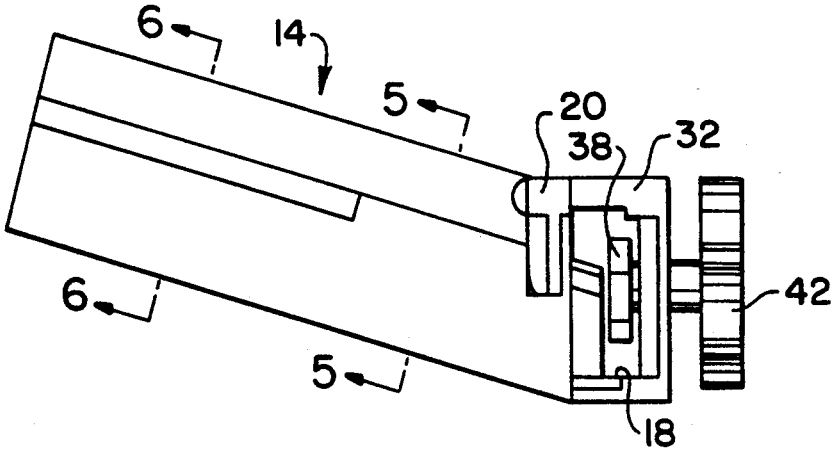
FIG. 2 is an elevational view of the magazine cartridge loader in the direction AA as shown in FIG. 1 with the magazine removed.
Figure 3:
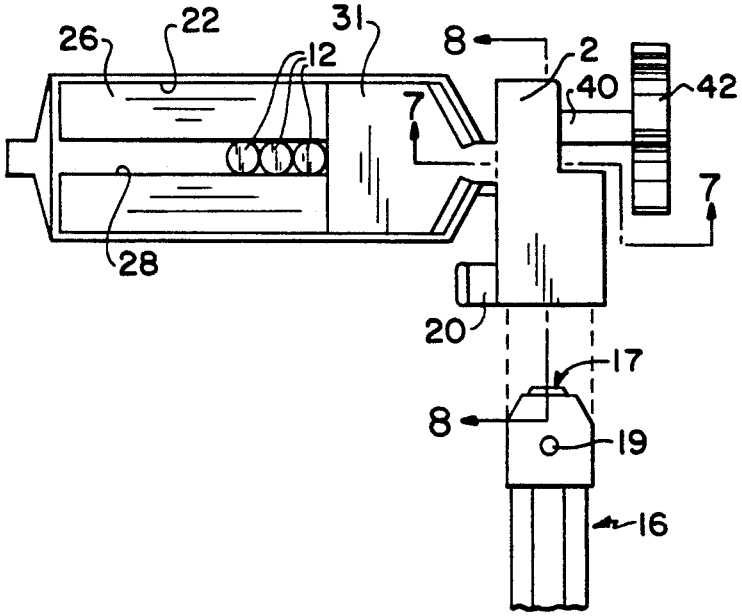
FIG. 3 is a top plan view of the magazine cartridge loader as shown in FIG. 2 with the magazine exploded away.
Figure 4:
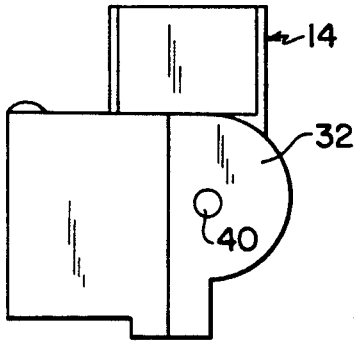
FIG. 4 is a right hand side view of the magazine cartridge loader as shown in FIG. 2 with the handle knob removed.

The magazine 16 is of conventional construction and is a common magazine used with firearms holding multiple cartridges for loading into the chamber of a firearm. This conventional magazine 16 has an opening at one end 17 for receiving and dispensing of cartridges which opening fits into an opening 18 of the loader 10 as shown in FIG. 2 and 3. This magazine further includes an internal spring (not shown) to bias cartridges to move toward the open end 17. This conventional magazine 16 further has two tabs 19 located on opposite sides of the exterior wall of the casing for the magazine which fit into corresponding slots (not shown) of the loader 10 in a conventional manner and a rotatable latch 20 holds the tabs within the slots thus holding the open end 17 of the magazine in the opening 18 of the loader 10 in a conventional manner.

Figure 5:
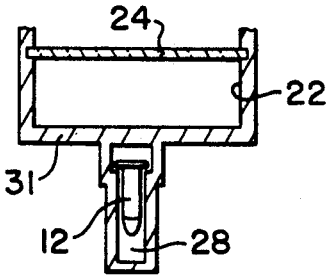
FIG. 5 is a cross-sectional view of the cartridge orienting device viewed along line 5—5 in FIG. 2.
Figure 6:
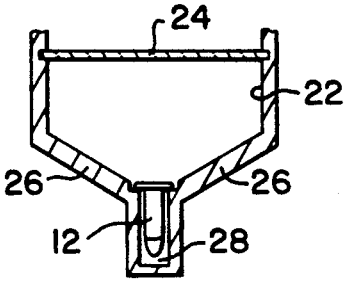
FIG. 6 is a cross-sectional view of the magazine orienting device viewed along 6—6 in FIG. 2.

The orienting device 14 includes a hollow receptacle 22 for receiving oriented cartridges 12. In a preferred embodiment a transparent lid 24 is divided for containing the cartridges within the hollow receptacle as shown in FIGS. 5 and 6. The hollow receptacle 22 has sloping bottom walls 26 which converge downwardly as shown in FIGS. 5 and 6 so that cartridges within the orienting device 14 will naturally gravitate toward the convergence of sloping bottom walls 26. A slot 28 is provided at the center of convergence of sloping bottom walls 26. The slot 28 is formed in size to accept a body of the cartridge 12 but is narrower than the diameter of a rim of the cartridge 12. As cartridges 12 roll down sloping bottom walls 26, the weight of the bullet causes the bullet and body portion of the cartridges to fall into slot 28 while the rims will be held by the edges of slot 28, acting as rails, to suspend the cartridges by their rims within slot 28. In this manner, unoriented cartridges 18 can be easily and rapidly oriented with the longitudinal axes of the cartridges being aligned in substantially parallel relation.

Figure 7:
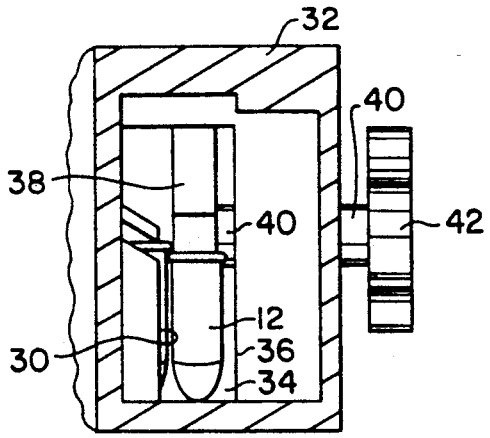
FIG. 7 is an enlarged view of the magazine cartridge loader as viewed along line 7—7 in FIG. 3.

An end of the cartridge orienting device 14 has an opening 30 providing a communication between slot 28 and the loader 10 as shown in FIG. 7. The orienting device 14 is fixedly secured to loader 10. When the loader 10 is used for loading cartridges into magazine 16, the orienting device 14 is positioned so that cartridges 12 within slot 28 will gravitate toward the opening 30 and the loader 10. The loader 10 is provided with an internal secondary cover 31 as shown in FIGS. 3 and 5.

Cartridge loader 10 has a loader body housing 32. The housing 32 encloses a cartridge accepting space 34 in communication with slot 28 of the cartridge orienting device 14. A stop wall 36 defines a boundary of the cartridge accepting space 34 and is spaced apart from the opening 30 of the cartridge orienting device 14 by the width of a single cartridge 12. A cartridge 12 can move from slot 28 into the cartridge accepting space 34 and against stop wall 36 with the bullet portion of the cartridge pointed downward and the cartridge rim aligned above the bullet as shown in FIG. 7.

A rotatable loading cam member 38 is also provided in the cartridge accepting space 34 as shown in FIG. 7 and FIGS. 8A, 8B and 8C. This loading cam member is connected by a stem 40 to a knob 42. By rotating knob 42, the cam member 38 is correspondingly rotated.

The cam member 38 is a substantially flat plate the one side of which is aligned generally parallel with stop wall 36 and the edge of which is generally aligned with the cartridge opening 17 of magazine 16 as shown in FIGS. 7, 8A, 8B and 8C.

Figure 8A:
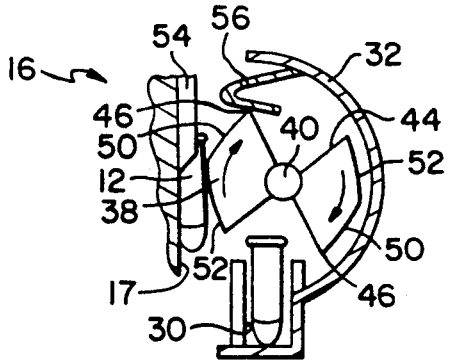
FIG. 8A is a cross sectional view along line 8—8 in FIG. 3 with the loading cam member in one position.
Figure 8B:
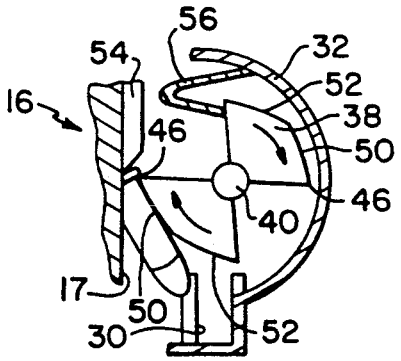
FIG. 8B is a cross sectional view along line 8—8 in FIG. 3 with the loading cam member in a second position later in time.

As shown in FIGS. 7, 8A, 8B and 8C cam 38 has a pair of cut out portions 44 each of which are sized to accept a cartridge 12 from opening 30 of slot 28 of the orienting device 14 as shown in FIG. 8A. The cam 38 is further provided with a pair of teeth 46 which engage the rim of a cartridge 12 and upon the rotation of cam 38 move the cartridge 12 out of the cartridge accepting space 34 as shown in FIG. 8B.

The cam member 38 further has a pair of corresponding cam surfaces 50 which cams the cartridge body against a cartridge held within magazine 16 through opening 17 when cam member 38 is further rotated as shown in FIG. 8B.

Figure 8C:
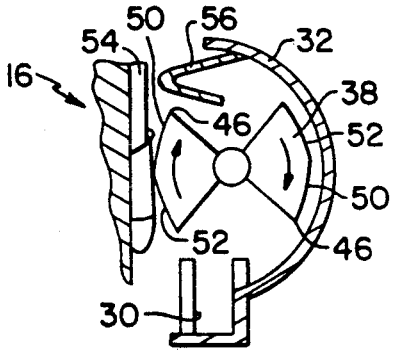
FIG. 8C is a cross sectional view along line 8—8 in FIG. 3 with the loading cam member in a third position still later in time.

Upon further rotation of cam 38 tooth 46 drives cartridge 12 through opening 17 and up and under lip 54 which holds the cartridge inserted in magazine 16. Upon further rotation of cam 38, tooth 46 slips by the rim of cartridge 12 and a second cam surface 52 of cam member 31 aligns cartridge 12 in an operative position within magazine 16 as shown in FIG. 8C.

In a preferred embodiment, a U-shaped plate spring 56 is provided in housing 32 to allow the cam member 38 to rotate in only one direction as shown in FIG. 8B. The U-shaped spring 56 has one leg attached to the housing member 32 and the other leg positioned to depend into the cut-out 44 as the cam 38 is rotated. The periphery of cam 38 cams this depending leg upwardly and out of the way when the cam is rotated in one direction but depends into the cut-out 44 and prevents rotation in the opposite direction as shown in FIGS. 8A and 8B.

In operation, magazine 16 is positioned with opening 17 of magazine 16 in communication with opening 18 of cartridge loader 10 with the tabs 19 in their respective slots. The latch 20 is then rotated so as to retain the magazine in operative connection with the loader 10. Unoriented cartridges 12 are then dumped into hollow receptacle 22 and lid 24 closed to retain the cartridges in the hollow receptacle as the receptacle is shaken. At least some of the cartridges will gravitate down bottom walls 26 toward slot 28 where the bullet nose of the cartridges will fall into the slot 28 but the rims of the cartridges will be held by the edge of bottom walls 26 adjacent slot 28. This action orients the cartridges in slot 28 with the cartridges in substantially parallel relation with the bullet portion depending from the rim portion.

The cartridge orienting device 14 is then positioned above loader 10 so that cartridges 12 held within slot 28 will gravitate toward opening 30. The rotatable cam member 38 is then rotated. One cartridge 12 will exit slot 28 and gravitate into the cartridge accepting space 34 against stop wall 36 and within cutout 44 of cam member 38. As cam member 38 is further rotated, a tooth 46 on the cam member 38 will engage the rim of cartridge 12 and move the cartridge out of the cartridge accepting space 34. As cam member 38 is further rotated with knob 42 the cam 38 tilts the cartridge 18 and forces the cartridge 18 into magazine 16 through opening 17 and upwardly under retaining lip 54 whereby the inserted cartridge is held within the magazine 16. Further rotation of cam member 38 will cause additional cartridges to be taken from the orienting device 14 and loaded into magazine 16.

While the fundamental novel features of the invention have been shown and described, it should be understood that various substitutions, modifications and variations may be made by those skilled in the art without parting from the spirit or scope of the invention. Accordingly, all such modifications or variations are included in the scope of the invention as defined by the following claims.

I claim:

1. An apparatus for loading cartridges, each having a longitudinal axis, a cartridge body and a cartridge rim, into a magazine having an open end, the apparatus comprising:

an orienting means for orienting the longitudinal axes of a plurality of unoriented cartridges in parallel relation;

an accepting means, connected to the orienting means, for accepting and holding one cartridge at a time from the orienting means;

a rotatable cam mounted adjacent the accepting means having an axis of rotation substantially perpendicular to the longitudinal axis of the cartridge held by the accepting means;

the rotatable cam having a tooth to engage the rim of a cartridge held in the accepting means and move the cartridge toward the open end of the magazine; and the rotatable cam further having a cam surface for directing the body of the cartridge toward the open end of the magazine and into the open end of the magazine upon further rotation of the rotatable cam.

2. An apparatus as described in claim 1 a knob means is connected to the rotatable cam for rotating the rotatable cam.

3. An apparatus as described in claim 1 wherein the rotatable cam includes a cutout portion sized to accept a cartridge positioned within the accepting means.

4. An apparatus as described in claim 1 further means for permitting the rotatable cam to rotate in only one direction.

5. An apparatus for loading cartridges, each having a longitudinal axis and a cartridge body, into a magazine having an open end, the apparatus comprising:

an orienting means for orienting the longitudinal axes of a plurality of unoriented cartridges in parallel relation;

an accepting means, connected to the orienting means, for accepting and holding one cartridge at a time from the orienting means;

a rotatable cam mounted adjacent the accepting means having an axis of rotation substantially perpendicular to he longitudinal axis of the cartridge held by the accepting means;

the rotatable cam having means for frictionally engaging a cartridge held in the accepting means and move the cartridge toward the open end of the magazine; and the rotatable cam further having a cam surface for directing the body of the cartridge toward the open end of the magazine and into the open end of the magazine upon further rotation of the rotatable cam.

* * * * *